US010766738B2

(12) United States Patent
Hsu et al.

(10) Patent No.: US 10,766,738 B2
(45) Date of Patent: Sep. 8, 2020

(54) OUT-OF-GROUP OPERATIONS FOR MULTICAR HOISTWAY SYSTEMS

(71) Applicant: Otis Elevator Company, Farmington, CT (US)

(72) Inventors: Arthur Hsu, South Glastonbury, CT (US); David Ginsberg, Granby, CT (US); Jose Miguel Pasini, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 485 days.

(21) Appl. No.: 15/547,925

(22) PCT Filed: Feb. 2, 2016

(86) PCT No.: PCT/US2016/016046
§ 371 (c)(1),
(2) Date: Aug. 1, 2017

(87) PCT Pub. No.: WO2016/126627
PCT Pub. Date: Aug. 11, 2016

(65) Prior Publication Data
US 2018/0022573 A1 Jan. 25, 2018

Related U.S. Application Data

(60) Provisional application No. 62/112,352, filed on Feb. 5, 2015.

(51) Int. Cl.
*B66B 1/24* (2006.01)
*B66B 5/02* (2006.01)
(Continued)

(52) U.S. Cl.
CPC ..... *B66B 1/2466* (2013.01); *B66B 1/28* (2013.01); *B66B 1/468* (2013.01); *B66B 5/0087* (2013.01);
(Continued)

(58) Field of Classification Search
CPC ..... B66B 1/2466; B66B 1/28; B66B 1/468
(Continued)

(56) References Cited

U.S. PATENT DOCUMENTS 4,129,199 A * 12/1978 MacDonald ..... B66B 1/20 187/387
8,387,757 B2 3/2013 Christy et al.
(Continued)

FOREIGN PATENT DOCUMENTS

CN 1154338 A 7/1997
CN 101323408 A 12/2008
(Continued)

OTHER PUBLICATIONS

International Search Report and Written Opinion for application PCT/US2016/016046, dated May 20, 2016, 9pgs.
(Continued)

*Primary Examiner* — David S Warren
(74) *Attorney, Agent, or Firm* — Cantor Colburn LLP

(57) ABSTRACT

A ropeless elevator system includes a plurality of elevator cars configured to travel in a hoistway having at least one lane, a propulsion system to impart force to each elevator car of the plurality of elevator cars, and a controller. The controller is programmed to operate in an in-group mode where the plurality of elevator cars perform service demands, an out-of-group mode where at least one selected elevator car of the plurality of elevator cars is prevented from performing the group service mode service demands, and a transition mode where the at least one selected elevator
(Continued)

car is prepared and transitioned from operation in the in-group mode to operation in the out-of-group mode.

16 Claims, 5 Drawing Sheets

(51) Int. Cl.

| | |
|---|---|
| ***B66B 5/00*** | (2006.01) |
| ***B66B 1/28*** | (2006.01) |
| ***B66B 1/46*** | (2006.01) |
| ***B66B 9/00*** | (2006.01) |
| ***B66B 11/04*** | (2006.01) |

(52) U.S. Cl.
CPC ..... *B66B 5/027* (2013.01); *B66B 9/00* (2013.01); *B66B 11/0407* (2013.01); *B66B 9/003* (2013.01); *B66B 2201/104* (2013.01); *B66B 2201/223* (2013.01); *B66B 2201/405* (2013.01); *B66B 2201/4676* (2013.01)

(58) Field of Classification Search
USPC ..... 187/247
See application file for complete search history.

(56) References Cited

U.S. PATENT DOCUMENTS

| | | | | |
|---|---|---|---|---|
| 2016/0167920 | A1* | 6/2016 | Freeman | B66B 1/2458 187/384 |
| 2016/0221791 | A1* | 8/2016 | Berryhill | B66B 1/468 |
| 2016/0251198 | A1* | 9/2016 | Salmikuukka | B66B 1/2458 187/388 |
| 2016/0376122 | A1* | 12/2016 | Van Dijk | B66B 1/2466 187/247 |
| 2017/0327345 | A1* | 11/2017 | Steinhauer | B66B 11/0407 |

FOREIGN PATENT DOCUMENTS

| | | | |
|---|---|---|---|
| CN | 100567118 | C | 12/2009 |
| EP | 0776856 | A2 | 6/1997 |
| JP | 2000063058 | A | 2/2000 |
| WO | 2012066937 | A1 | 5/2012 |
| WO | 2014158127 | A1 | 10/2014 |
| WO | 2014182284 | A1 | 11/2014 |

OTHER PUBLICATIONS

Chinese Office Action for application CN 2018121801537480, dated Dec. 21, 2018, 6 pages.

* cited by examiner

OUT-OF-GROUP OPERATIONS FOR MULTICAR HOISTWAY SYSTEMS

FIELD OF INVENTION

The subject matter disclosed herein relates generally to the field of elevators, and more particularly to out-of-group elevator car operations in an elevator system.

BACKGROUND

Self-propelled elevator systems, also referred to as ropeless elevator systems, are useful in certain applications (e.g., high rise buildings) where the mass of the ropes for a roped system is prohibitive and there is a desire for multiple elevator cars to travel in a single lane. There exist self-propelled elevator systems in which a first lane is designated for upward traveling elevator cars and a second lane is designated for downward traveling elevator cars. A transfer station at each end of the hoistway is used to move cars horizontally between the first lane and second lane.

BRIEF DESCRIPTION OF THE INVENTION

According to one embodiment of the invention, a ropeless elevator system is provided. The ropeless elevator system includes a plurality of elevator cars configured to travel in a hoistway having at least one lane, a propulsion system to impart force to each elevator car of the plurality of elevator cars, and a controller. The controller is programmed to operate in an in-group mode where the plurality of elevator cars perform service demands, an out-of-group mode where at least one selected elevator car of the plurality of elevator cars is prevented from performing the group service mode service demands, and a transition mode where the at least one selected elevator car is prepared and transitioned from operation in the in-group mode to operation in the out-of-group mode.

In addition to one or more of the features described above, or as an alternative, further embodiments may include: wherein the propulsion system is a linear propulsion system comprising a primary portion mounted in the hoistway, the primary portion comprising a plurality of motor segments, and a plurality of secondary portions, wherein at least one secondary portion of the plurality of secondary portions is mounted to one elevator car of the plurality of elevator cars; wherein in the in-group mode the service demands are passenger calls; wherein in the transition mode the controller is programmed to receive an out-of-group initiation request, provide an initiation request acknowledgement and/or initiation request information, and provide a car readiness notification that the transition of the at least one selected elevator car from the in-group mode operation to the out-of-group mode operation is complete; wherein receiving an out-of-group initiation request further comprises authenticating an authorized user; wherein receiving an out-of-group initiation request further comprises providing related out-of-group selection parameters and options; wherein receiving an out-of-group initiation request further comprises satisfying preconditions of the transition; and/or wherein in the out-of-group mode the controller is programmed to provide out-of-group controls and receive an in-group return initiation request.

According to another embodiment of the invention, a method of controlling a ropeless elevator system comprising a plurality of elevator cars configured to travel in a hoistway having at least one lane and a propulsion system to impart force to each elevator car of the plurality of elevator cars is provided. The method includes operating in an in-group mode where the plurality of elevator cars perform service demands, selectively operating in an out-of-group mode where at least one selected elevator car of the plurality of elevator cars is prevented from performing the group service mode service demands, and performing a transition mode to prepare and transition the at least one selected elevator car from the in-group mode to the out-of-group mode.

In addition to one or more of the features described above, or as an alternative, further embodiments may include: wherein performing service demands includes performing passenger calls; wherein performing a transition mode comprises receiving an out-of-group initiation request and providing an initiation request acknowledgement and/or initiation request information; wherein performing a transition mode further comprises providing a car readiness notification that the transition of the at least one selected elevator car from the in-group mode operation to the out-of-group mode operation is complete; wherein receiving an out-of-group initiation request comprises authenticating an authorized user; wherein receiving an out-of-group initiation request comprises providing related out-of-group selection parameters and options; wherein receiving an out-of-group initiation request comprises satisfying preconditions of the transition; and/or wherein operating in the out-of-group mode comprises providing out-of-group controls and receiving an in-group return initiation request.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
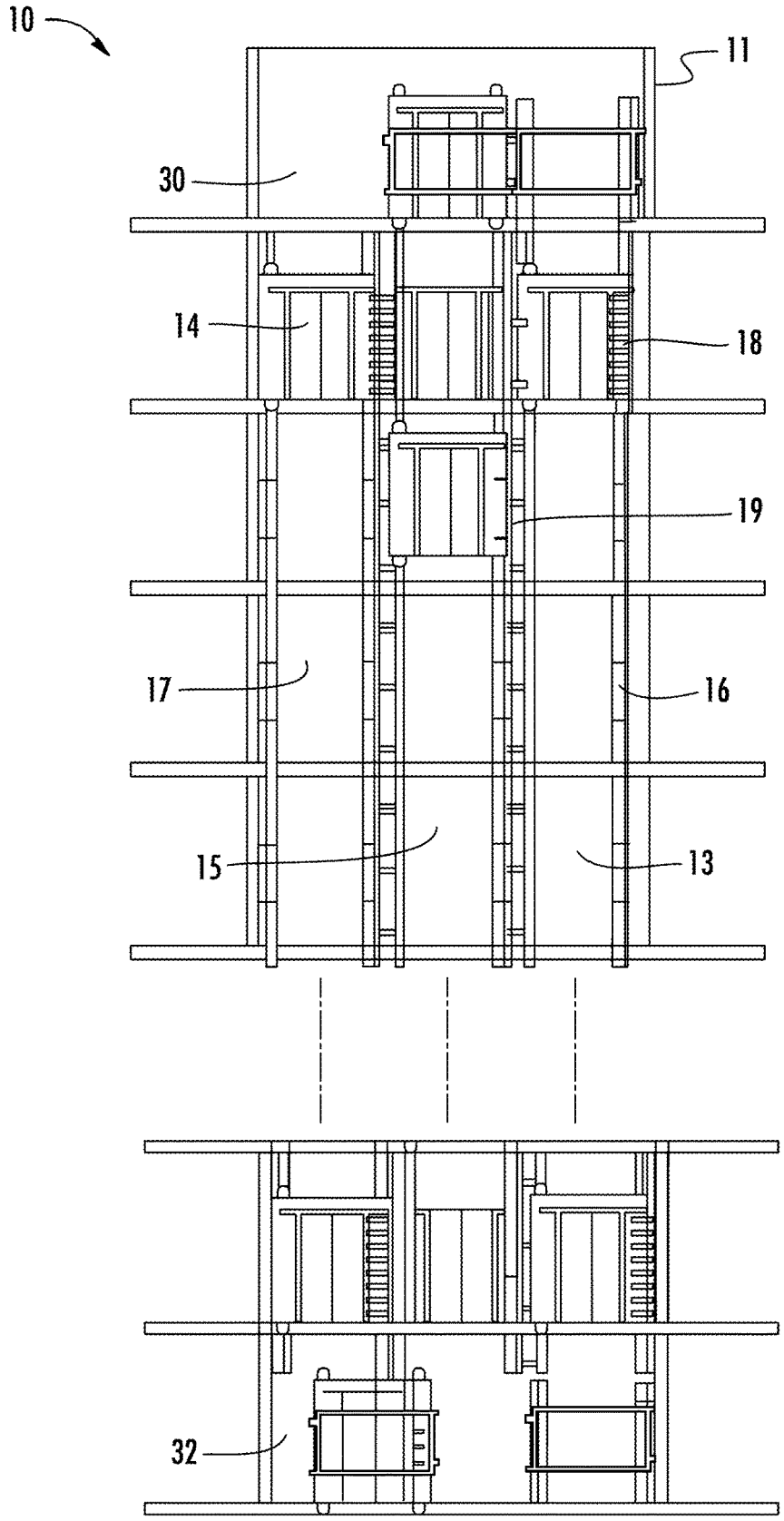
FIG. 1 depicts a multicar ropeless elevator system in accordance with an exemplary embodiment.

FIG. 1 depicts a multicar, self-propelled elevator system 10 in an exemplary embodiment. Elevator system 10 includes hoistway 11 having a plurality of lanes 13, 15 and 17. While three lanes are shown in FIG. 1, it is understood that embodiments may be used with multicar, self-propelled elevator systems have any number of lanes. In each lane 13, 15, 17, cars 14 travel in one direction, i.e., up or down. For example, in FIG. 1 cars 14 in lanes 13 and 15 travel up and cars 14 in lane 17 travel down. One or more cars 14 may travel in a single lane 13, 15, and 17. In some embodiments, the cars may travel in more than one direction in a lane.

Above the top floor is an upper transfer station 30 to impart horizontal motion to elevator cars 14 to move elevator cars 14 between lanes 13, 15 and 17. It is understood that upper transfer station 30 may be located at the top floor, rather than above the top floor. Below the first floor is a lower transfer station 32 to impart horizontal motion to elevator cars 14 to move elevator cars 14 between lanes 13, 15 and 17. It is understood that lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and lower transfer station 32.

Cars 14 are propelled using a linear motor system having a primary, fixed portion 16 and a secondary, moving portion 18. The primary portion 16 includes windings or coils mounted at one or both sides of the lanes 13, 15 and 17. Secondary portion 18 includes permanent magnets mounted to one or both sides of cars 14. Primary portion 16 is supplied with drive signals to control movement of cars 14 in their respective lanes.

Figure 2:
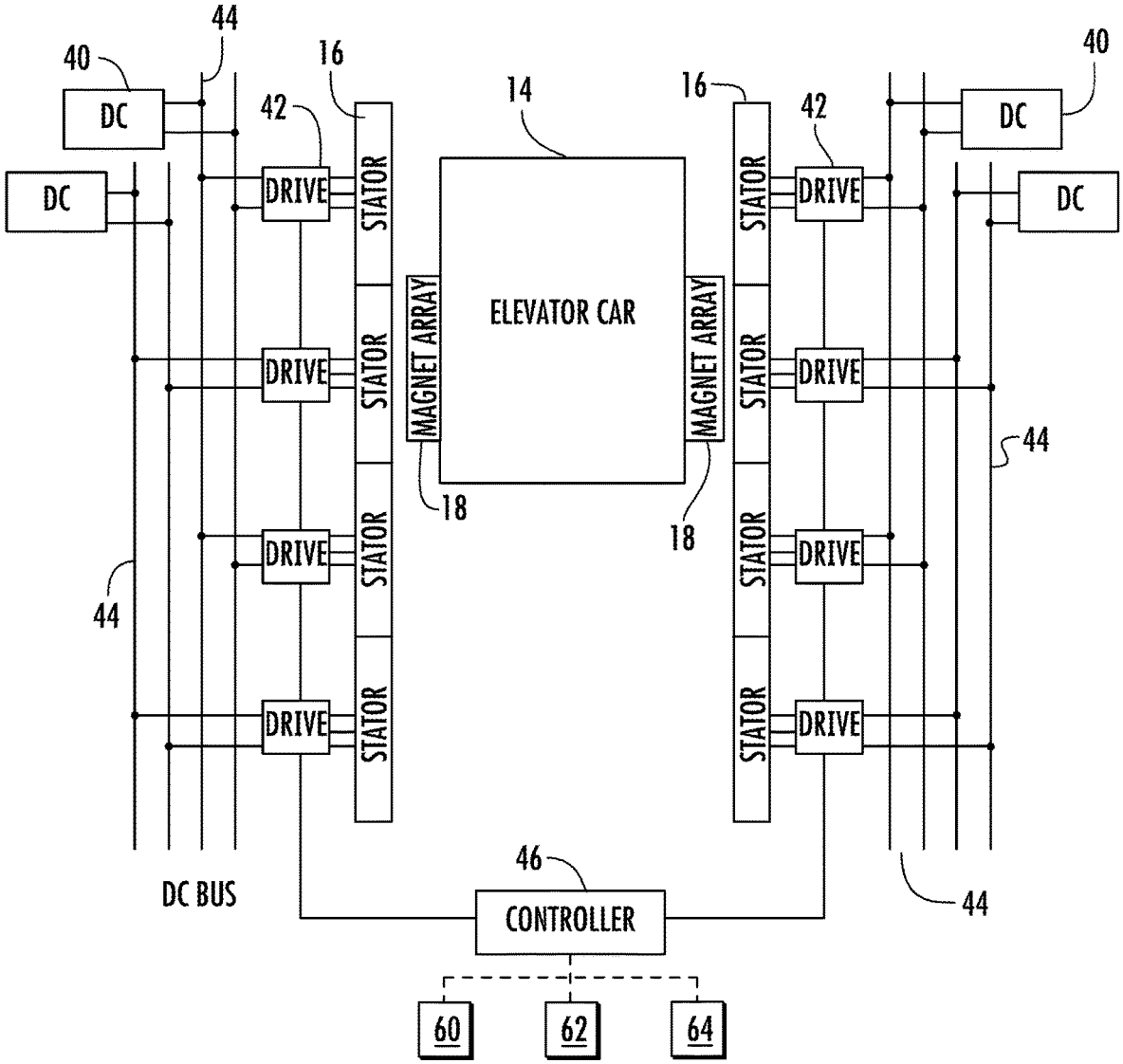
FIG. 2 depicts components of a drive system in an exemplary embodiment.

FIG. 2 depicts components of a drive system in an exemplary embodiment. It is understood that other components (e.g., safeties, brakes, etc.) are not shown in FIG. 2 for ease of illustration. As shown in FIG. 2, one or more DC power sources 40 are coupled to one or more drives 42 via one or more DC buses 44. DC power sources 40 may be implemented using storage devices (e.g., batteries, capacitors) or may be active devices that condition power from another source (e.g., rectifiers). Drives 42 receive DC power from the DC buses 44 and provide drive signals to the primary portion 16 of the linear motor system. Each drive 42 may be a converter that converts DC power from DC bus 44 to a multiphase (e.g., 3 phase) drive signal provided to a respective section of the primary portions 16. The primary portion 16 is divided into a plurality of motor sections, with each motor section associated with a respective drive 42.

A controller 46 provides control signals to the each of the drives 42 to control generation of the drive signals. Controller 46 may use pulse width modulation (PWM) control signals to control generation of the drive signals by drives 42. Controller 46 may be implemented using a processor-based device programmed to generate the control signals. Controller 46 may also be part of an elevator control system or elevator management system.

Figure 3:
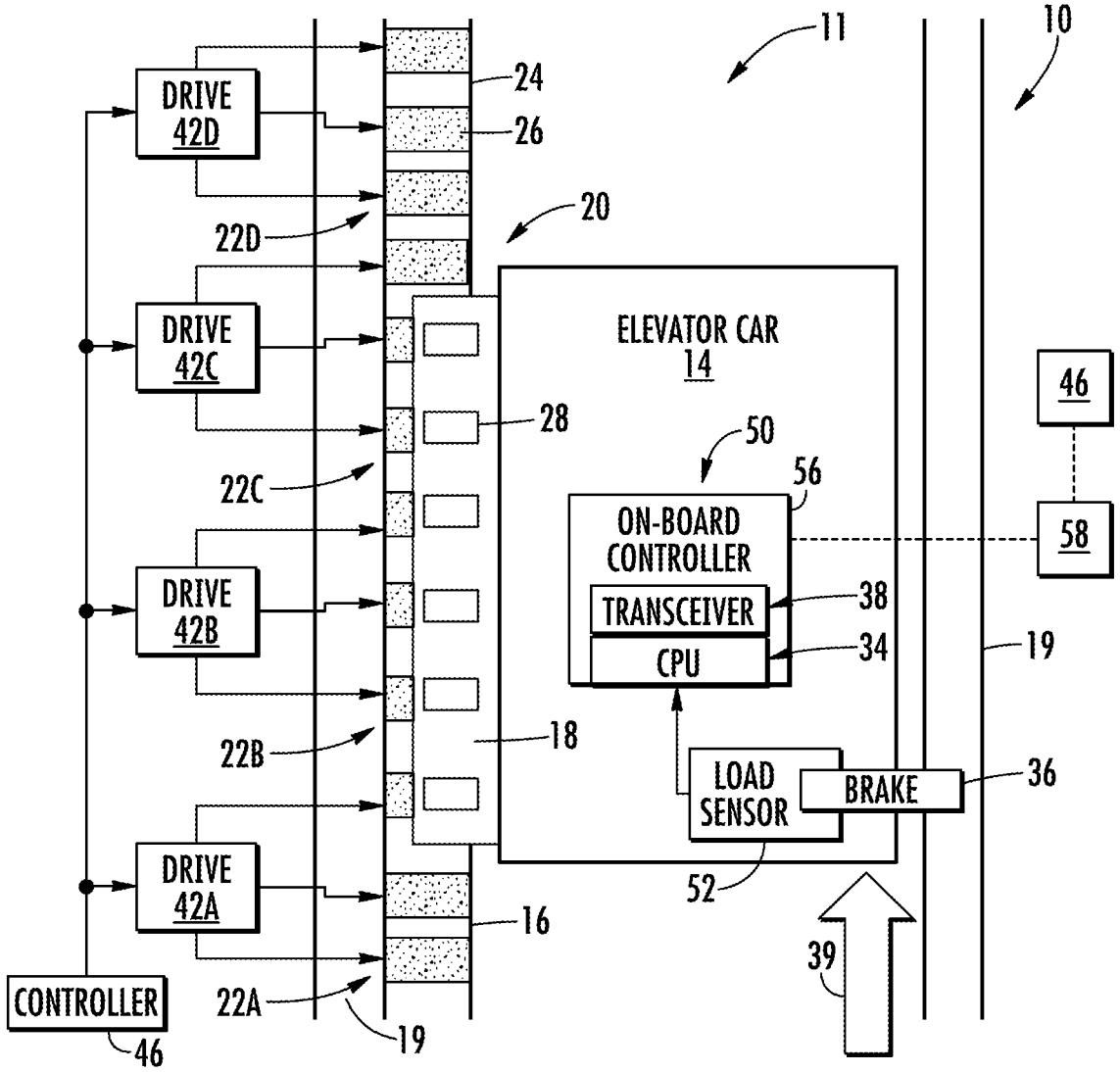
FIG. 3 depicts a portion of the elevator system in accordance with an exemplary embodiment.

FIG. 3 depicts another view of the elevator system 10 including an elevator car 14 that travels in hoistway 11. Elevator car 14 is guided by one or more guide rails 24 extending along the length of hoistway 11, where the guide rails 24 may be affixed to structural member 19. For ease of illustration, the view of FIG. 3 only depicts a single guide rail 24; however, there may be two or more guide rails 24 positioned, for example, on opposite sides of the elevator car 14. Elevator system 10 employs a propulsion system such as a linear propulsion system 20, where primary portion 16 includes multiple motor segments 22 each with one or more coils 26 (i.e., phase windings). Primary portion 16 may be mounted to guide rail 24, incorporated into the guide rail 24, or may be located apart from guide rail 24. Primary portion 16 serves as a stator of a permanent magnet synchronous linear motor to impart force to elevator car 14. Secondary portion 18 is mounted to the elevator car 14 and includes an array of one or more permanent magnets 28 as a second portion of the linear propulsion system 20. Coils 26 of motor segments 22 may be arranged in three phases, as is known in the electric motor art. One or more primary portions 16 may be mounted in the hoistway 11, to coact with permanent magnets 28 mounted to elevator car 14. The permanent magnets 28 may be positioned on two sides of elevator car 14; although, only a single side of elevator car 14 that includes permanent magnets 28 is depicted in the example of FIG. 3. Alternate embodiments may use a single primary portion 16—secondary portion 18 configuration, or multiple primary portion 16—secondary portion 18 configurations.

In the example of FIG. 3, there are four motor segments 22 depicted as motor segment 22A, motor segment 22B, motor segment 22C, and motor segment 22D. Each of the motor segments 22A-22D has a corresponding drive 42A-42D. A controller 46 provides drive signals to the motor segments 22A-22D via drives 42A-42D to control motion of the elevator car 14. Controller 46 may be implemented using a microprocessor executing a computer program stored on a storage medium to perform the operations described herein. Alternatively, controller 46 may be implemented in hardware (e.g., ASIC, FPGA) or in a combination of hardware/software. Controller 46 may also be part of an elevator control system. Controller 46 may include power circuitry (e.g., an inverter or drive) to power the primary portion 16. Although a single controller 46 is depicted, it will be understood by those of ordinary skill in the art that a plurality of controllers 46 may be used. For example, a single controller 46 may be provided to control the operation of a group of motor segments 22 over a relatively short distance.

In exemplary embodiments, the elevator car 14 includes an on-board controller 56 with one or more transceivers 38 and a processor, or CPU, 34. The on-board controller 56 and the controller 46 collectively form a control system 50 where computational processing may be shifted between the on-board controller 56 and the controller 46. In exemplary embodiments, the processor 34 is configured to monitor one or more sensors and to communicate with one or more controllers 46 via the transceivers 38. In exemplary embodiments, to ensure reliable communication, elevator car 14 may include at least two transceivers 38. The transceivers 38 can be set to operate at different frequencies, or communications channels, to minimize interference and to provide full duplex communication between the elevator car 14 and the one or more controllers 46. In the example of FIG. 3, the on-board controller 56 interfaces with a load sensor 52 to detect an elevator load on a brake 36. The brake 36 may engage with the structural member 19, a guide rail 24, or other structure in the hoistway 11. Although the example of FIG. 3 depicts only a single load sensor 52 and brake 36, elevator car 14 can include multiple load sensors 52 and brakes 36.

Elevator loads observed by the load sensor 52 can be computed locally by the on-board controller 56 or sent wirelessly to the controller 46 via transceiver 38 for further processing. As one example, the on-board controller 56 can stream data from the load sensor 52 in real-time as it is collected. Alternatively, the on-board controller 56 can time stamp or otherwise correlate elevator load data with timing information prior to sending the elevator load data to the controller 46.

Example Elevator System Operation

Elevator system 10 is configured to operate each elevator car 14 in an "in-group" mode or an "out-of-group" mode. An elevator car 14 is in-group when the car is available to serve ordinary traffic demand such as responding to passenger calls. An elevator car 14 is out-of-group when the car is turned off or reserved for some special function that may make it unavailable to serve ordinary traffic. Typically, elevator cars 14 are in-group by default until an authorized user takes the car out of group service.

Elevator system 10 is also configured to operate in a transition mode to transition one or more elevator cars 14 from the in-group mode to the out-of-group mode to meet the specialized demand of the desired out-of-group car operation. This may include preparation of each elevator car 14 for the designated out-of-group operation. This transition mode operation is particularly important in multicar hoistway systems, such as those described herein, due to potential conflicts between multiple, simultaneously operating elevator cars.

During normal use, elevator system 10 operates elevator cars 14 in the in-group mode. When switching one or more cars 14 to out-of-group, the transition mode generally includes: (A) initiating (or receiving) an out-of-group request, (B) receiving (or providing) a request acknowledgement and/or information, and (C) providing a car readiness notification that the transition is complete. The out-of-group mode operation subsequently includes: (D) providing out-of-group controls, and (E) initiating (or receiving) an in-group return request (or a request to leave the out-of-group mode).

(A) Initiating the Out-Of-Group Request

Initiating the out-of-group request may further include: (A1) accessing a control terminal, (A2) authentication of an authorized user, (A3) providing related out-of-group selection parameters and options, and (A4) satisfying transition preconditions.

(A1) Accessing Control Terminal

Accessing a control terminal may include accessing a control terminal 58 (FIG. 3) that is in signal communication with controller 46. Control terminal 58 may be one or more kiosks, key switches, keypads, computer terminals, touch screens, audio recognition devices, or the like. Further, control terminal 58 may be located in any suitable location such as in building hallways, in elevator cars, and/or security areas. Control terminal 58 may be a mobile or handheld device or may be located remotely from the building. Control terminal 58 may communicate in any suitable manner such as via a building management system, via wireless, via internet, a Local Area Network (LAN) or Controller Network (which may not be related to other building networks), or the like.

(A2) Authentication of Authorized User

Authentication of an authorized user may include requiring the user to input a login code, engage a key switch, or swipe a keycard to initiate the out-of-group request. However, any suitable method of authentication may be used that enables system 10 to function as described herein. Alternatively, system 10 may not require user authentication.

(A3) Providing Related Out-Of-Group Selection Parameters and Options

Providing related out-of-group selection parameters and options generally includes providing classes of parameters to enable the user to define the type of out-of-group feature desired for one or more elevator cars 14. In one embodiment, elevator system 10 generally includes four classes of parameters: (A3-1) specification of the elevator car, (A3-2) location where the feature is initiated/requested, (A3-3) position range; and (A3-4) type of functions performed as part of the feature.

The first class of parameters/options, specification of the elevator car (A3-1), may provide the user with car designation options such as: (a) designating a specific car (e.g., user wants to fix a problem on a particular car), (b) designating a specific class of car (for example, there may be different classes of cars with certain characteristics such as service cars or high capacity cars), (c) designating any cars in a specific lane, and/or (d) designating any cars in any lanes.

The second class of parameters/options, location where the feature is initiated/requested (A3-2), may provide the user with location options such as: (a) at a particular door opening at a particular floor, (b) at a particular floor (specific lane does not matter), (c) at a particular maintenance area (e.g., a maintenance garage or sub-basement), (d) at a particular parking area (e.g., a place to store cars), and/or (e) at a particular position in a lane or transfer area (e.g., at a rise of 20.3 m, which may not correspond with a door opening). For example, the specification of the location may be such that a car arrives so that the user can enter the interior of the car normally, but also where some other part of the car is accessible. For example, a mechanic may want to inspect equipment on top of the car, in which case the desire would be for the car to arrive to a location where the mechanic can walk onto the roof of the car.

The third class of parameters/options, position range (A3-3), may provide a user with position range options such as: (a) designating a range of floors that is a subset of a lane (e.g., floors seven through twelve), (b) designating a range of vertical positions (e.g., 20.5 m through 31.7 m) that may not necessarily align with floor positions, (c) designating a range of horizontal positions in a lateral transfer area 30, and/or (d) designating a range or duration of time (e.g., a time limit) to operate in the out-of-group mode before the car is returned (e.g., automatically) to the in-group operation. However, the portion of the lane that is outside the designated range may still be used for in-group operations.

The fourth class of parameters/options, type of functions performed as part of the feature preparation (A3-4), may provide a user with specific operational options for each car, and further sub-options related to preparation for the specified operation. For example, the user may be provided with operation options for the car such as a "car recall-maintenance" option and a "car recall-fire" option. Accordingly, the user may pick a predefined out-of-group operation for a specific car, which may then automatically choose or define parameters/options (A3-1), (A3-2), and/or (A3-3). Other predefined operations are described herein in more detail.

Once an operation for the car is selected, the user may be provided with various sub-options for preparation of the selected option. For example, the user may be provided with "pre-emptive control" option and a "non-pre-emptive control" option. With pre-emptive control, for example, the car ignores all existing demand and requires passengers to immediately exit the car so it may be used as soon as possible. With non-pre-emptive control, for example, the car serves all existing demand (but will not take new demand) before switching to the out-of-group operation.

(A4) Satisfying Transition Preconditions

Satisfying transition preconditions includes making sure predefined conditions are satisfied so that the selected elevator car 14 can properly and safely transition to the selected out-of-group operation. The required preconditions may vary depending on the selected type of out-of-group operation and/or the specific car type.

For example, the preconditions may include: (a) the controller first allows cars that have already been assigned to traverse a selected range, (b) the controller ensures that any existing demand assigned to the car designated for out-of-group service is served (e.g., non-pre-emptive operation), (c) the controller ensures that cars not serving the out-of-group operation are moved outside of the selected range, (d) the controller does not assign traffic to a car that would be required to traverse the selected range, (e) the controller commands the designated car to move to the initiation location (note that the controller may need to plan and command the car to come from a different lane), and/or (f) the controller positions in-group cars in preparation before the out-of-group car takes exclusive control of the selected range (for example, the portion of the lane above the selected range may be used for in-group service, but may be isolated from the rest of the system, so the controller may place a predefined number of in-group cars in this portion of the lane before it is blocked off). Only after the defined preconditions are satisfied can the selected cars 14 then proceed to the out-of-group operation.

(B) Receiving Request Acknowledgement and/or Information

Receiving request acknowledgement and/or information may include: (a) receiving acknowledgement of the out-of-group request, (b) receiving denial/approval of the request, and/or (c) providing information related to the out-of-group request. For example, (a) receiving acknowledgement may include an audio or visual signal indicating that the request is approved (e.g., lighting a button), (b) the request may be denied if, for example, granting the request would violate a higher-level constraint such as one that always allows in-group service to some floors, and (c) providing information may include a status of the selected car (e.g., car is powered off, estimated time until car will be ready for specialized operation). Another example of providing status information may occur when a set of steps must be performed during the transition mode, and system 10 may provide the user with information about which step is being performed. The acknowledgement and status information may be provided on a display or audio device whether installed in the elevator/building or a mobile device, and whether local or remote to system 10.

(C) Car Readiness Notification

The car readiness notification that the transition is complete signals or alerts the user that one or more cars 14 are ready for the selected out-of-group service. This may include: (a) a visual, audible, or tactile notification (e.g., text on an interface screen, a bell, or vibration of a handheld device), and (b) a further user authentication. The further user authentication may be required because it may take some time to prepare the elevator car for the out-of-group mode, even if the initial request for the out of group mode was authenticated. During that time, the authorized user may have left the initiation location and it may be undesirable for an unauthorized user to take control of the car.

(D) Providing Out-Of-Group Controls

Providing out-of-group controls includes system 10 providing one or more specific series of user interfaces during out-of-group operation. In such cases, the user is provided with control options specific to the designated out-of-group operation.

For example, there may be a need to operate the car from inside the car, which can be achieved using a car operator panel, a wireless input device, or a device connected to a port inside the car. The commands from the user may be a target floor command or a target hoistway position command (e.g., independent service mode), or a desired current velocity (e.g., for inspection mode). This input device may be connected to the car such as by installation on the car or by a wireless connection.

In another example, there may be a need to operate the car from outside the car. For example, in a mass recall operation, a first responder may want to first check that the car is empty, exit the car, then provide an input to close the doors and inspect the next car. Additionally, in the car recall out-of-group operation, the user may be further provided with specific control options such as "recall car 1", "recall car 2", and "recall all cars." User selection may then bring the designated car(s) to, for example, the ground floor for inspection.

In addition, during the out-of-group operation, controller 58, 46 may perform the following: (a) assigning new demand without interfering with the selected range of the out-of-group operation, and/or (b) account for required car separation or other constraints when utilizing the lane for other operations (both in-group and out-of-group).

(E) Initiating an In-Group Return Request

Initiating an in-group return request enables a user to return elevator cars 14 to in-group service once the out-of-group operation is completed. As such, the user may access control terminal 58 to return the cars to in-group service. This may require an additional user authentication step, prompt passengers to exit the car, and/or include a signal that the out-of-group service mode is completed and the car will return to normal in-group service or another operation mode.

Example Method of Operation

Figure 4:
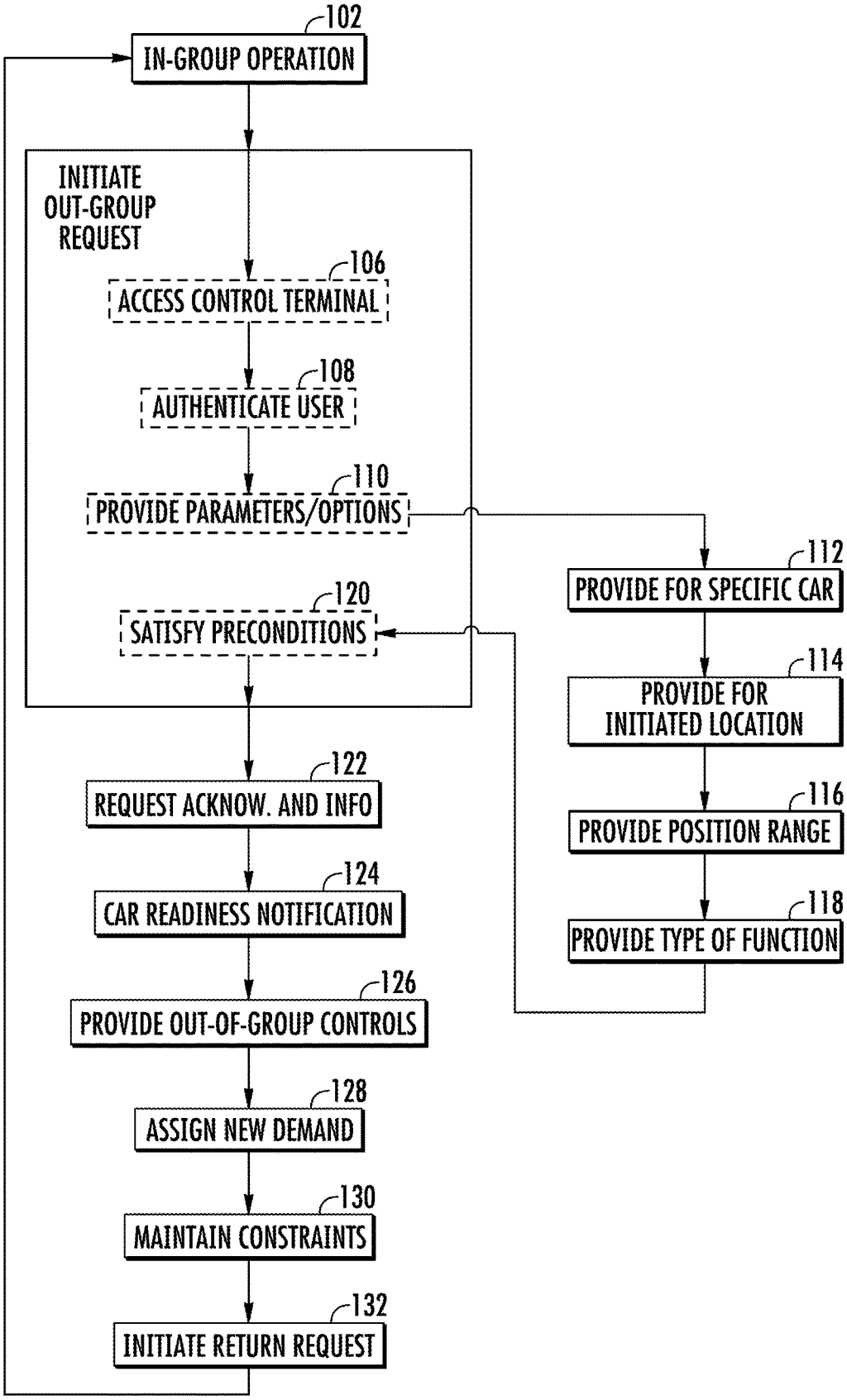
FIG. 4 depicts an exemplary method of operating a multicar ropeless elevator system.

With reference to FIG. 4, an example method 100 of operating elevator system 10 may start, at step 102, with operating a plurality of elevator cars 14 in a plurality of elevator lanes in the in-group mode. At step 104, an out-of-group request is initiated, which may include accessing a control terminal (step 106), authentication of an authorized user (step 108), providing related out-of-group selection parameters and options (step 110), and satisfying transition preconditions (step 120).

Providing related out-of-group selection parameters and options (step 110) may include providing parameters/options related to the specification of the elevator car (step 112), providing parameters/options related to a location where the out-of-group feature is initiated/requested (step 114), providing parameters/options related to a position range (step 116), and providing parameters/options related to the type of car functions performed as part of the out-of-group feature (step 118).

At step 120, it is determined if preconditions related to the transition of the elevator car from the in-group mode to the selected out-of-group mode are satisfied. At step 122, an out-of-group request acknowledgement and information is received. At step 124, a car readiness notification is provided to indicate the car transition to the out-of-group mode is complete and/or to notify a user that the selected car(s) are ready for the selected out-of-group service.

At step 126, controls are provided to the user for control of the elevators car during the out-of-group operation. At step 128, any new demand occurring during the out-of-group operation may be assigned such that it does not interfere with the selected out-of-group operation. At step 130, any constraints of the out-of-group operation are maintained throughout. At step 132, the user initiates a request to return the out-of-group elevator car to the in-group operation. Control may then return to step 102.

Example Out-Of-Group Operations

Elevator system 10 may include many various specific, out-of-group features or operations such as: (a) a non-pre-emptive range operation, (b) a pre-emptive range operation, (c) an inspection operation, (d) a maintenance call operation, (e) a pre-emptive recall operation, (f) a non-pre-emptive recall operation, (g) a mass recall operation, (h) a car shutdown operation, (i) a range shutdown operation, (j) a clearing trip operation, (k) a lane cycling test run operation, (l) a transfer area operation, (m) a demand-serving operation without passenger calls, and (n) a rescue operation.

(a) Non Pre-Emptive Range Operation

The non-pre-emptive range operation may occur, for example, when someone requires the use of a lane between two floors. As such, the user "reserves" the space between the designated floors. A particular car may be commanded by an operator (typically but not necessarily inside the car using a car operating panel where the destination floors can be specified). As such, the operator defines a selected range.

The controller that is responsible for the cars that are in-group ensures that no other car can interfere with the out-of-group car regardless of where in the selected range the out-of-group car is located. As such, the controller does not assign any other car in that lane to service any demand within the selected range or any demand that would require traversing the selected range. The controller may further prevent another car from serving demand close to the selected range depending on a required separation distance between the out-of-group car and other cars. Accordingly, the out-of-group car can freely operate within the selected range without interfering with other cars, while the controller is free to operate one or more in-group cars in the portion of the lane of and/or below the selected range.

When using this operation, the controller may specify a range that is a subset of a lane, specify any part of a horizontal transfer area, specify an initiation location, serve existing demand commitments before switching to the out-of-group mode, assign future demand without interfering with the selected range, pre-position cars for future demand before allowing the range to be reserved by the designated car indefinitely, account for required separation and other such constraints in utilizing the portion of the lane (or transfer area) for other operations (whether in-group or out-of-group), and specifying a duration of time (or a time limit) after which the car is automatically returned to group operation.

(b) Pre-Emptive Range Operation

The pre-emptive range operation attempts the start the out-of-group operation as soon as possible. For example, in a hospital, a car may need to be made available immediately for a particular scenario. The pre-emptive range operation is similar to the non-pre-emptive range operation, but differs in that existing passenger trips may be preempted such that the passengers en route to their destination may be asked to exit the car at some other floor, and other passengers waiting for a specific car may have their calls canceled. If possible, passengers whose service is preempted are notified.

In this operation, the controller may further preempt service in the designated car and other cars that are affected (e.g., passengers may be force to disembark at some destination) besides the car that was designated for the out-of-group operation. This may be supplemented with additional interfaces (display, voice announcement, turning off the car call button indicators on which floors will be served) to inform passengers that their service has been interrupted.

The controller may further preempt existing car assignments to users waiting for an elevator. In cases when the waiting users have already been notified about the car that they will be assigned, this may be supplemented with additional interfaces (display, voice announcement, turning off the hallway call buttons, etc.) to inform passengers that their service has been interrupted.

(c) Inspection Operation

The inspection operation enables a mechanic to inspect and perform service operation in a lane (i.e., not inside the car). This may involve maintenance on top of the car (or elsewhere on the car) or it could involve maintenance in the lane (e.g., using the car as a platform to look at rail alignment, wiring, etc.).

Related out-of-group selection parameters and options for this operation may include: [for specification of the elevator car (A3-1)] (a) designation of a specific car for performing maintenance on that car, (b) specifying a service car (e.g., one with a platform and railings) for performing maintenance in the lane, (c) determining if any car is suitable for certain types of maintenance in the lane; [for location where the feature is initiated/requested (A3-2)] (a) the initiation location may be where the mechanic (or service device, e.g., a robot) is located, (b) a landing (i.e., a building floor) but such that the car's floor is not aligned with the landing (e.g., for access to the top of the car); and [for position range (A3-3)] (a) a single floor (if the maintenance is performed on the car and the car does not need to move), or (b) a range of lane positions.

In addition, the controller not only ensures that no other car encroaches on the selected range, but also, because a mechanic may be working on a car, the controller maintains a spatial buffer above or below the selected range in which no other car should be allowed to enter. The controller may optionally be configured to ensure that no power (e.g., for linear electric motors in the lane) is distributed within the "buffer area." The inspection operation may be operated pre-emptively and non-pre-emptively.

Special features for entering the lane may be made available during the inspection operation such as signaling to the mechanic (or service device) that the car is ready at the initiation location, opening the door (or allowing the doors to be opened) only when the car is properly positioned at the initiation location, and not requiring defeating standard safety safeguards (e.g., apply jumper cables). After that, the mechanic or service device may manually control the position of the car within the selected range, for example, at a reduced speed.

Unique elements of the inspection operation include: (a) specifying of a particular class of cars (e.g., a special service platform with safety equipment or other equipment such as power outlets designed for inspection and maintenance), (b) specifying an initiation location whereby the controller moves the car such that the service platform level (which may be the roof of the car) is aligned with the landing, (c) ensuring the selected car operates only within the selected range, and (d) adding additional constraints (e.g., extra buffer space, slower operation of nearby cars) to account for mechanic safety while working inside the lane.

(d) Maintenance Call Operation

The maintenance call operation calls a specific car to a designated maintenance area. A specific car and location are designated, but designation of a range may not be applicable.

(e) Pre-Emptive Recall Operation

The pre-emptive recall operation includes bringing one or more cars to a particular floor for inspection of the contents of the cars. The recall user may be, for example, a security guard who has detected that an alarm has been triggered or a fireman checking each car to ensure that no one is trapped therein.

In this pre-emptive operation, the car is brought to the recall user as directly as possible. As such, passengers inside the car will be brought to this location regardless of their previous call request. Preconditions may include allowing cars that have already been assigned to traverse the selected range, ensure cars not being recalled are moved outside of the selected range, and commanding the car to move to the initiation location. This clears a path for the car to the recall location without opening the doors of the recalled car. Additionally, the doors may or may not be opened automatically (e.g., until an open command).

(f) Non-Pre-Emptive Recall Operation

The non-pre-emptive recall operation is similar to the pre-emptive recall operation except that additional preconditions include ensuring that any existing demand assigned to the car is served, and/or not assigning traffic to a car that would be required to traverse the selected range.

(g) Mass Recall Operation

The mass recall operation may be utilized in building emergencies such as a fire. First responders must ensure that no one is trapped or incapacitated in an elevator. The standard procedure is for the first responders to check each and every car and visually inspect that no one is inside after which the car can only be controlled by the first responders.

In multicar systems, the first responders recall cars to a specific location or locations where the cars are checked. The order of the cars may not be important, but it is important to check every car. In this operation, the controller brings each car to a recall location. In one embodiment, the controller may automatically keep track of which cars have not yet been checked. An interface between the first responder and controller may be provided such that the first responder can confirm a car is clear before that car is moved away and another car that needs to be checked can be moved to the recall location. The controller accommodates multiple cars in the same lane by planning a sequence of cars based on locations of the cars including those cars in transfer areas.

(h) Car Shutdown Operation

The car shutdown operation allows one or more elevator cars 14 to be shut down (i.e., de-powered). A specific car and position in lane or transfer area is specified. The operation may be pre-emptive or non-pre-emptive. Preconditions may include ensuring the car is empty (e.g., weight sensor, camera verification) before the controller performs the car shutdown.

(i) Range Shutdown Operation

The range shutdown operation allows a subset of the elevator system to be shut down (e.g., de-powered to save energy), to ensure that a subset of the elevator system is vacated (e.g., to accommodate maintenance operations), and/or ensure that a car does not move (e.g., to hold a car while passengers inside are being rescued). The selected range could be an entire lane or transfer area, or just a portion of the lane or transfer area.

The parameters/options selected include the position range and what type of shutdown operation is requested. The operation may be pre-emptive or non-pre-emptive. The controller may then signal for the range to shut down (e.g., drives or motor segments that power that range) or to hold the car (e.g., lock the brakes).

(j) Clearing Trip Operation

The clearing trip operation includes inspecting the architectural integrity of the system for a certain event such as an initial commissioning or after an earthquake event. This may be done utilizing a camera mounted on an elevator car 12 that is running at slow speed. In a multicar scenario, only a subset of cars may be equipped for the clearing operation and other cars may need to be moved out of the way.

The parameters/options selected include specifying the class of cars with the clearing equipment capability and specifying the required range. In the transition mode, the selected elevator car is brought into the selected range and other cars are moved out of the range. The controller moves the car throughout the range at a predetermined speed. However, if the clearing operation is manual, an interface is provided between the controller and the user. The interface may allow the user to interrupt the motion and to backtrack for further inspection.

When there is more than one car equipped for the clearing trip operation, the controller can coordinate multiple cars for the operation, track which parts of the system have been cleared, and ensure that the operation collectively covers the entire target area.

(k) Lane Cycling Test Run Operation

The lane cycling test run operation performs a lane cycling test run where an elevator car 14 runs the length of a lane or a portion of the lane in both directions (i.e., up and down). The parameters/options selected include specifying any car in a specific lane and specifying a range in the selected lane. Other cars are cleared out of the selected range of the cycle test and the car designated for the cycle test run is positioned at one end of the selected range. The controller then commands the car to perform the lane cycling test.

Additionally, multiple cars may jointly perform this operation to save time. For example, the cars can be operated in a circulation pattern covering more than one lane. As such, there is no need to clear cars out of the selected range since all cars in the circulation pattern are part of the cycling test. In another example, a plurality of cars do runs of sections of the lane, and the controller keeps track of the portion of the lane tested until it has been fully checked.

(l) Transfer Area Operation

The transfer area operation includes other operations that are described herein, but which are utilized for horizontal transfer areas as well. This includes the cycling test operation wherein one or more transfer devices do a full run of the transfer zone, with or without a car, and the clearing trip operation where the transfer device is operated remotely for inspecting the transfer zone and/or the lanes. The inspection device (e.g., camera, sensor) may be mounted on the transfer device or on an appropriately equipped car that is being carried by the transfer device.

(m) Demand-Serving Operation without Passenger Calls

The demand-serving operation without passenger calls includes operation where elevator cars 14 are intended to move passengers but without passenger calls (i.e., where the passenger does not press any buttons). This operation may be utilized, for example, when a connection between the elevator buttons and the controller is malfunctioning, or when the passengers are restricted from pressing any buttons.

A multi-lane operation includes a circulation pattern involving two or more lanes where at least one lane carries cars upwards and at least one lane carries cars downwards. The controller moves each car from one landing to an adjacent landing, opens the doors of the car for some time, closes the doors and then proceeds to the next landing. Upon arriving at the terminal, the car is transferred to a lane in the opposite direction. As such, without pressing any buttons, a passenger could travel between any two floors.

A passenger interface may be included that indicates which floors are served by a car, so that a circulation pattern can skip one or more floors. For example, in a high-rise building, an "express" circulation pattern may be combined with a "local" circulation pattern which stops at every floor, so that users can reach their destination faster even though an elevator change may be required during their trip.

A single-lane operation includes operating one or more cars in a single lane without transferring to a different lane. In one embodiment, a single car travels up and down the lane stopping at every landing. In another embodiment, multiple cars each stop at every landing within a respective range. The ranges overlap so that a user can travel from any floor to any other floor, but may need to transfer to another car.

The controller ensures that multiple cars in the same lane are operating safely with sufficient separation, and passenger interfaces may be included to indicate which floors are served by each car.

(n) Rescue Operation

The rescue operation may be utilized when it is necessary to "rescue" a disabled elevator car 14 using one or more auxiliary cars. The rescue operation may include a first phase to rescue trapped passengers and a second phase to move the car out of the lane to an area where it does not block the lane and may be serviced. The auxiliary car may be a special car with equipment to assist in the rescue operation.

The first phase may include putting the disabled car on a range shutdown operation to lock the car in place, and the controller ensures that the car will not respond to normal signals to move. The controller clears any cars that are blocking the positioning of the auxiliary car(s) or towing movement of the disabled car. One or more auxiliary cars may then be moved close to the disabled car. The passengers may be evacuated from the disabled car to the auxiliary car(s), for example, through a ceiling trap door or by opening a side panel in the auxiliary car. The positioning of the auxiliary car may be a manual operation (e.g., a mechanic using a special interface to position the car with fine precision control), or at least in part coordinated automatically by sending a special rescue operation command that positions the auxiliary car optimally based on the information managed by the controller about the position of the disabled car (e.g., the car could be commanded to automatically match the position of the disabled car in the adjacent lane).

The second phase may include positioning one or more auxiliary cars to assist in the movement of the disabled car. For example, a special "towing car" could be linked to the disabled car above and/or below the disabled car. Alternatively or additionally, towing cars could be positioned alongside the disabled car in adjacent lanes. The controller manages the positioning of the auxiliary cars, mindful of the configuration of the propulsion system. For example, if the auxiliary car and the disabled car are in the same lane and are close to each other and if the cars are propelled by linear motor primary sections, the controller may need to be mindful that powering a linear motor primary section may simultaneously overlap with the secondary sections of both the disabled car and the primary car. In moving the disabled car, the controller would need to be capable of coordinating the propulsion control on all of the cars (the disabled car and the auxiliary cars).

Although various out-of-group operations are described herein, performing various other out-of-group operations is within the scope of elevator system 10. Additionally, during out-of-group operations, the elevator system controller(s) continues to ensure maximal traffic performance with all available elements of system 10, and may redirect traffic flow accordingly.

Figure 5:
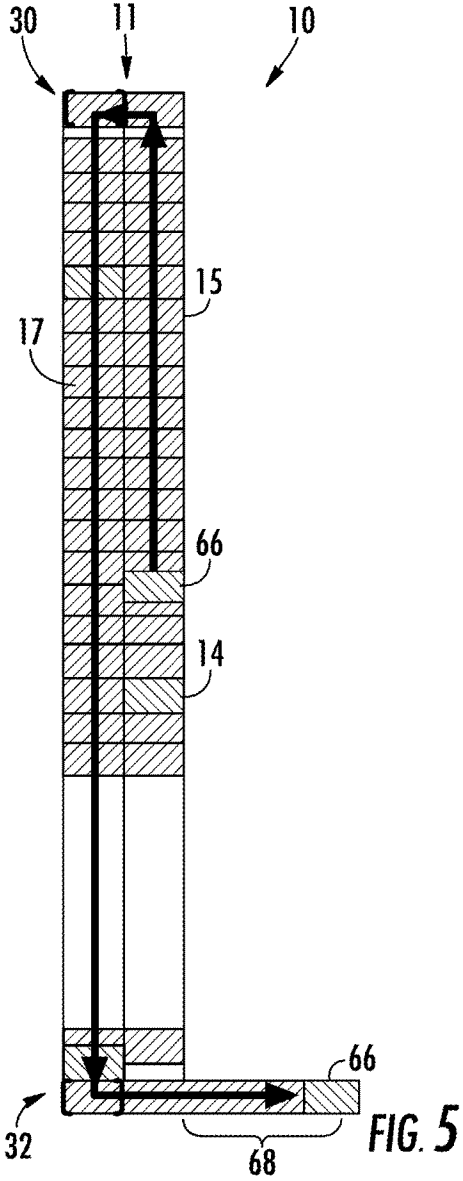
FIG. 5 depicts a multicar ropeless elevator system in accordance with another exemplary embodiment.

FIG. 5 illustrates an out-of-group operation to move one or more specific elevator cars 66 to a designated location or area 68 in elevator system 10. For example, when elevator car 66 requires maintenance, the out-of-group mode may be initiated via control terminal 58 and elevator car 66 is subsequently moved to designated area 68, which may be a parking or maintenance area.

Figure 6:
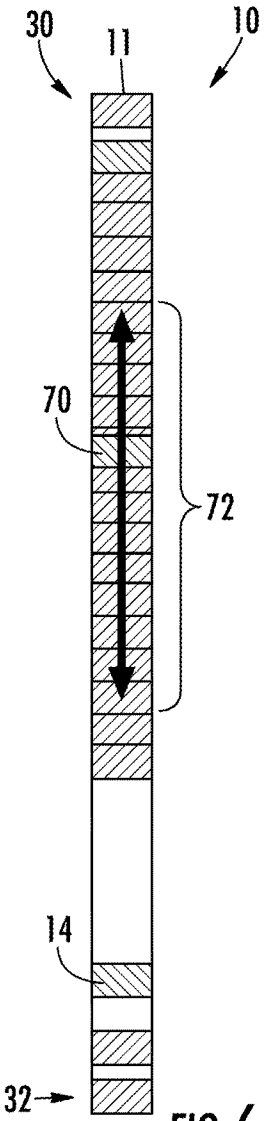
FIG. 6 depicts a multicar ropeless elevator system in accordance with yet another exemplary embodiment.

FIG. 6 illustrates an out-of-group operation to commandeer one or more specific elevator cars 70 to have exclusive operational capacity over a reserved location or area 72 within hoistway 11. Normal group service may be allowed above and/or below reserved area 72. This operation may be utilized, for example, when a car requires operation between only a few floors of a lane (e.g., between floors 10 and 15) or when a user needs to get on top of the elevator car to inspect the interior of the lane.

Figure 7:
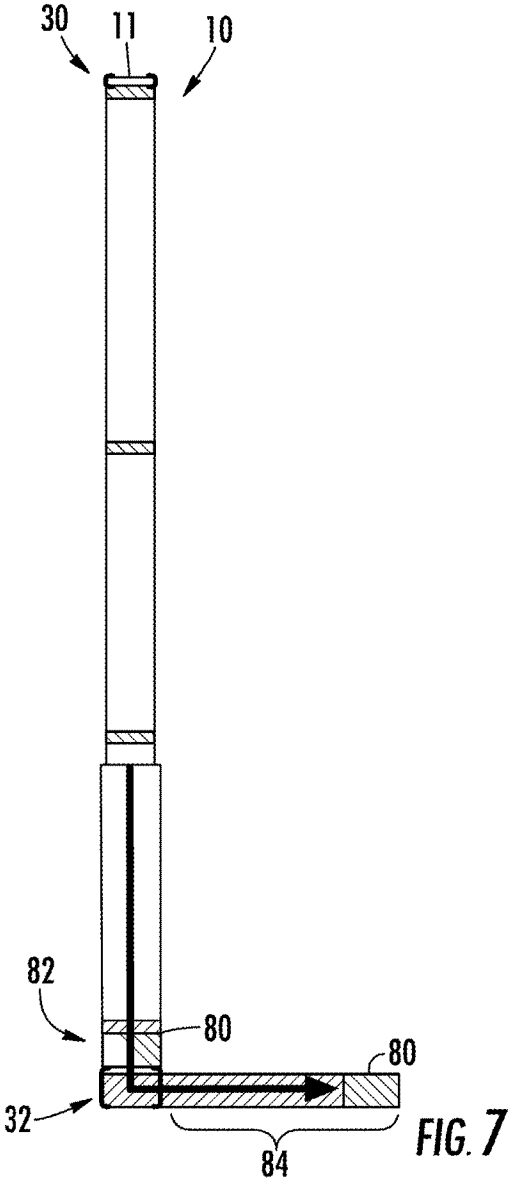
FIG. 7 depicts a multicar ropeless elevator system in accordance with yet another exemplary embodiment.

FIG. 7 illustrates an out-of-group operation to recall one or more specific elevator cars 80 to a specific location or area 82. This operation may be utilized, for example, during a fire event to recall each car 80 one by one to the lobby floor for inspection and confirmation by a firefighter that each car 80 is unoccupied.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A ropeless elevator system comprising:

a plurality of elevator cars configured to travel in a hoistway having at least one lane;

a propulsion system to impart force to each elevator car of the plurality of elevator cars; and a controller programmed to operate in:

an in-group mode where the plurality of elevator cars perform service demands;

an out-of-group mode where at least one selected elevator car of the plurality of elevator cars is prevented from performing the group service mode service demands; and a transition mode where the at least one selected elevator car is prepared and transitioned from operation in the in-group mode to operation in the out-of-group mode;

wherein the controller is programmed to operate in the transition mode after authenticating an authorized user and satisfying preconditions of the transition mode.

2. The ropeless elevator system of claim 1, wherein the propulsion system is a linear propulsion system comprising:

a primary portion mounted in the hoistway, the primary portion comprising a plurality of motor segments; and a plurality of secondary portions, wherein at least one secondary portion of the plurality of secondary portions is mounted to one elevator car of the plurality of elevator cars.

3. The ropeless elevator system of claim 1, wherein in the in-group mode the service demands are passenger calls.

4. The ropeless elevator system of claim 1, wherein in the out-of-group mode the controller is programmed to:

provide out-of-group controls; and receive an in-group return initiation request.

5. A ropeless elevator system comprising:

a plurality of elevator cars configured to travel in a hoistway having at least one lane;

a propulsion system to impart force to each elevator car of the plurality of elevator cars; and a controller programmed to operate in:

an in-group mode where the plurality of elevator cars perform service demands;

an out-of-group mode where at least one selected elevator car of the plurality of elevator cars is prevented from performing the group service mode service demands; and a transition mode where the at least one selected elevator car is prepared and transitioned from operation in the in-group mode to operation in the out-of-group mode;

wherein in the transition mode the controller is programmed to:

receive an out-of-group initiation request;

provide an initiation request acknowledgement and/or initiation request information; and provide a car readiness notification that the transition of the at least one selected elevator car from the in-group mode operation to the out-of-group mode operation is complete.

6. The ropeless elevator system of claim 5, wherein receiving an out-of-group initiation request further comprises authenticating an authorized user.

7. The ropeless elevator system of claim 5, wherein receiving an out-of-group initiation request further comprises providing related out-of-group selection parameters and options.

8. The ropeless elevator system of claim 5, wherein receiving an out-of-group initiation request further comprises satisfying preconditions of the transition.

9. A method of controlling a ropeless elevator system comprising a plurality of elevator cars configured to travel in a hoistway having at least one lane and a propulsion system to impart force to each elevator car of the plurality of elevator cars, the method comprising:

operating in an in-group mode where the plurality of elevator cars perform service demands;

selectively operating in an out-of-group mode where at least one selected elevator car of the plurality of elevator cars is prevented from performing the group service mode service demands; and performing a transition mode to prepare and transition the at least one selected elevator car from the in-group mode to the out-of-group mode;

wherein performing the transition mode occurs after authenticating an authorized user and satisfying preconditions of the transition mode.

10. The method of claim 9, wherein performing service demands includes performing passenger calls.

11. The method of claim 9, wherein operating in the out-of-group mode comprises:

providing out-of-group controls; and receiving an in-group return initiation request.

12. A method of controlling a ropeless elevator system comprising a plurality of elevator cars configured to travel in a hoistway having at least one lane and a propulsion system to impart force to each elevator car of the plurality of elevator cars, the method comprising:

operating in an in-group mode where the plurality of elevator cars perform service demands;

selectively operating in an out-of-group mode where at least one selected elevator car of the plurality of elevator cars is prevented from performing the group service mode service demands; and performing a transition mode to prepare and transition the at least one selected elevator car from the in-group mode to the out-of-group mode;

wherein performing the transition mode comprises:

receiving an out-of-group initiation request; and providing an initiation request acknowledgement and/or initiation request information.

13. The method of claim 12, wherein performing a transition mode further comprises providing a car readiness notification that the transition of the at least one selected elevator car from the in-group mode operation to the out-of-group mode operation is complete.

14. The method of claim 12, wherein receiving an out-of-group initiation request comprises authenticating an authorized user.

15. The method of claim 12, wherein receiving an out-of-group initiation request comprises providing related out-of-group selection parameters and options.

16. The method of claim 12, wherein receiving an out-of-group initiation request comprises satisfying preconditions of the transition.

* * * * *